US010591116B2

(12) United States Patent
Gao et al.

(10) Patent No.: US 10,591,116 B2
(45) Date of Patent: Mar. 17, 2020

(54) LIGHT EMITTING DIODE ILLUMINATION DEVICE

(71) Applicant: XIAMEN ECO LIGHTING CO. LTD., Xiamen (CN)

(72) Inventors: Yanzeng Gao, Xiamen (CN); Minghao Wu, Xiamen (CN); Feng Wu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/436,509

(22) Filed: Feb. 17, 2017

(65) Prior Publication Data

US 2018/0106434 A1 Apr. 19, 2018

(30) Foreign Application Priority Data

Oct. 17, 2016 (CN) ..... 2016 1 0903045

(51) Int. Cl.

| | |
|---|---|
| ***F21K 9/237*** | (2016.01) |
| ***F21V 23/00*** | (2015.01) |
| ***F21K 9/90*** | (2016.01) |
| ***F21V 29/70*** | (2015.01) |
| ***F21K 9/238*** | (2016.01) |
| ***F21K 9/232*** | (2016.01) |

(Continued)

(52) U.S. Cl.

CPC ..... *F21K 9/237* (2016.08); *F21K 9/232* (2016.08); *F21K 9/238* (2016.08); *F21K 9/90* (2013.01); *F21V 3/061* (2018.02); *F21V 23/005* (2013.01); *F21V 23/009* (2013.01); *F21V 23/06* (2013.01); *F21V 29/70* (2015.01); *F21Y 2101/00* (2013.01); *F21Y 2107/30* (2016.08); *F21Y 2107/40* (2016.08); *F21Y 2107/50* (2016.08); *F21Y 2107/70* (2016.08); *F21Y 2115/10* (2016.08)

(58) Field of Classification Search

CPC ..... F21K 9/232; F21K 9/238

See application file for complete search history.

(56) References Cited

U.S. PATENT DOCUMENTS 6,220,722 B1 * 4/2001 Begemann ..... F21V 3/00 362/231

8,933,619 B1 * 1/2015 Ou ..... F21K 9/135 313/317

(Continued)

*Primary Examiner* — Alexander K Garlen

(74) *Attorney, Agent, or Firm* — Chun-Ming Shh; Lanway IPR Services

(57) ABSTRACT

A light emitting diode illumination device comprises a light-transmitting encapsulant, a transparent core, a light source plate stereoscopic structure and a power supply device. The light-transmitting encapsulant and the transparent core can be made of glass material. The light source plate stereoscopic structure is constituted by a plurality of connecting sub-light source plates. The light source plate stereoscopic structure installed in the light-transmitting encapsulant is connected to the transparent core, and is supported by the transparent core. The sub-light source plate comprises a circuit board body and light-emitting diode dies. The light-emitting diode dies can be installed on one surface of the circuit board body by surface-mount technology. The power supply device is used for supplying power to the sub-light source plates, so that a plurality of sub-light source plates may provide illumination through the light-transmitting encapsulant.

18 Claims, 9 Drawing Sheets

(51) Int. Cl.

| | |
|---|---|
| ***F21V 3/06*** | (2018.01) |
| ***F21V 23/06*** | (2006.01) |
| ***F21Y 107/40*** | (2016.01) |
| ***F21Y 107/70*** | (2016.01) |
| ***F21Y 107/30*** | (2016.01) |
| ***F21Y 101/00*** | (2016.01) |
| ***F21Y 115/10*** | (2016.01) |
| ***F21Y 107/50*** | (2016.01) |

(56) References Cited

U.S. PATENT DOCUMENTS 9,338,835 B2 * 5/2016 Chen ..... F21V 29/004
2004/0114367 A1 * 6/2004 Li ..... F21K 9/232 362/248
2010/0207502 A1 * 8/2010 Cao ..... F21V 3/00 313/46
2011/0169431 A1 * 7/2011 Li ..... F21V 3/02 315/363
2011/0298371 A1 * 12/2011 Brandes ..... F21V 23/005 315/32
2011/0299292 A1 * 12/2011 Preuschl ..... H05K 1/189 362/382
2012/0056542 A1 * 3/2012 Hu ..... F21V 29/70 315/113
2012/0206933 A1 * 8/2012 Isogai ..... F21V 3/02 362/555
2012/0291269 A1 * 11/2012 Fiene ..... F21V 29/20 29/825
2013/0114253 A1 * 5/2013 Segawa ..... F21V 29/004 362/235
2013/0271989 A1 * 10/2013 Hussell ..... F21V 29/004 362/249.02
2014/0232288 A1 * 8/2014 Brandes ..... H05B 33/0803 315/250
2015/0098223 A1 * 4/2015 Su ..... F21V 29/51 362/249.02
2016/0341370 A1 * 11/2016 Dekker ..... F21V 29/004
2016/0369949 A1 * 12/2016 Wu ..... H05B 35/00

* cited by examiner

LIGHT EMITTING DIODE ILLUMINATION DEVICE

FIELD OF THE INVENTION

The present invention relates to a light emitting diode illumination device, and more particularly to a light emitting diode illumination device having a transparent core.

BACKGROUND OF THE INVENTION

As Light Emitted Diode technology continues to progress, more and more products are designed by utilizing the characteristics of light emitting diodes. In addition to replacing conventional lamps, a variety of light bulbs have also been developed.

Light emitting diode is abbreviated to LED, which is made by compounds including gallium (Ga), arsenic (As), phosphorus (P), nitrogen (N) and so on. Visible light can be emitted when the electrons recombine with the holes, therefore it can be utilized to make light emitting diodes. Light emitting diodes can be used as indicators in a circuit and an instrument, or be assembled to display characters or numbers. Gallium arsenide diodes emit red light, gallium phosphide diodes emit green light, silicon carbide diodes emit yellow light, while gallium nitride diodes emit blue light. Light emitting diodes can be further classified into organic light emitting diodes (OLEDs) and inorganic light emitting diodes (LEDs) because of their chemical properties.

Lighting is an important part of human life. Therefore, although LED technology is quite mature already, people still look forward to having more life-quality enhancing lighting products. In order to accomplish different product designs, there are a variety of technical issues to be resolved, including heat dissipation, power connection, driving, even manufacturing cost and complexity.

SUMMARY OF THE INVENTION

According to an embodiment of the present invention, a light emitting diode illumination device is provided. The light emitting diode illumination device can be a light bulb, a lamp incorporating a battery, or an illumination device of other application types. The light emitting diode illumination device comprises a light-transmitting encapsulant, a transparent core, and a light source plate stereoscopic structure. The light-transmitting encapsulant and the transparent core can be made by glass, plastic or other transparent materials.

The light source plate stereoscopic structure can be comprised by a plurality of sub-light source plates. The light source plate stereoscopic structure disposed in the light-transmitting encapsulant is connected with the transparent core, and is supported thereby. The sub-light source plate comprises a circuit board body and one or more light-emitting diode dies. The light-emitting diode dies may be arranged in an equal distance, or may be disposed unequally from each other in a predetermined manner, depending on the shape and the design of the illumination device. For example, in order to have more illumination on the side surface and the bottom surface, light emitting diode dies can be disposed more intensively in particular areas of the sub-light source plate. In addition, the surface of the light-emitting diode dies can be coated with phosphors, in order to produce different color temperatures. A plurality of light emitting diode dies having different color temperatures may be provided on the same circuit board body.

The light emitting diode dies are disposed on one side of the circuit board body, and are connected with each other in series via various packaging and wiring manners. For example, the light emitting diode dies can be mounted to the circuit board body by a surface mount device (SMD) packaging manner. Also, the present invention can be utilized in a light source plate comprising light emitting diodes packaged by the Chip on Board (COB) technology. However, for factories that are already familiar with the surface mount devices, COB technology is not necessarily employed. Therefore, manufacturing flexibility can be greatly enhanced while costs are reduced.

A power supply device supplies power to the sub-light source plates, in order to allow the sub-light source plates to provide illumination through the light-transmitting encapsulant. In the embodiment of the light bulb, the power supply device can be a corresponding driving circuit and a wire. The driving circuit is adapted to convert the voltage of the indoor power source into a voltage suitable for driving the light emitting diode dies of the sub-light source plate, so as to emit light. In other embodiments, the power supply device may further comprise a battery or simply a wire, so as to connect with an electrical power source.

When the embodiment of this illumination device is a light bulb, the illumination device may include a light bulb cap. The light-transmitting encapsulant may be a light-transmitting encapsulant part corresponding to a variety of different types of light bulbs. For example, for T-type bulb shells, A-type bulb shells, G-type bulb shells, R-type bulb shells, BR-type bulb shells, PAR-type bulb shells, candle-type bulb shells or any other existing bulb shapes.

In the embodiment of the light bulb, the driving circuit may be housed in an accommodating space of the light bulb cap. In other words, only the light source plate stereoscopic structure and the transparent core are visible through the light-transmitting encapsulant. The circuit elements of the driving circuit are not visible. The driving circuit may be partially shaded, so that the components of the driving circuit are not exposed directly, affecting the overall appearance of the light bulb product.

A heat sink can be further provided to better dissipate heat, so as to increase the life of the light bulb or the illumination device. For example, a cooling cup, a cooling material, or various linings may be placed inside the light bulb cap, so as to dissipate heat of the driving circuit and the sub-light source plates.

In addition, a wire can be embedded in the transparent core. A first group of terminals and a second group of terminals are further provided on both sides of the wire, respectively. The first group of terminals are electrically connected to the sub-light source plates, while the second group of terminals are electrically connected to the power supply device. Alternatively, the wires may be connected to the sub-light source plates and the power source device along the surface or exterior of the core.

Furthermore, the sub-light source plates may be different portions of one light source circuit board. The light source circuit board is folded to have a folding angle between the sub-light source plates, so as to form the light source plate stereoscopic structure. In other words, the LED dies can be mounted on a large circuit board, then the wires are installed. The circuit board is then cut into a predestinated shape, leaving grooves suitable for folding. Next, each light source circuit board is folded to form a light source plate stereoscopic structure, following by connecting with the transparent core. This approach can significantly reduce costs and difficulty of installation.

In addition, a portion of the light source circuit board can be folded to constitute a top portion of the light source circuit board. The top portion of the light source circuit board is connected to a top portion of the transparent core and is supported thereby.

The top portion of the light source circuit board can further comprises light emitting diode dies. In addition, the top portion of the light source circuit board may be provided with a buckle structure, so as to be fastened to the top portion of the transparent core. In addition, the top portion of the light source circuit board can also be connected with the transparent core via adhesive or welding.

Furthermore, another portion of the light source circuit board may be folded to constitute a bottom portion of the light source circuit board. The bottom portion of the light source circuit board is connected to a bottom portion of the transparent core and is supported thereby.

The light source circuit board can be folded into a variety of stereoscopic structures. For example, the plurality of sub-light source plates may be folded to constitute a polygonal column structure. In order to ensure the modularity and stability of the light source plate stereoscopic structure, when the light source circuit board is folded to constitute the polygonal column structure, two of the sub-light source plates are connected with each other through a corresponding buckles. In other words, when the light source circuit board is folded into a polygonal shape, the last two side ends can be fastened by buckle structures, so as to form a hollow cylinder structure. In addition, the shape of the light source plate stereoscopic structure can also be ensured by adhesive or welding. Furthermore, these sub-light source plates can also be connected with the connecting structure between the transparent core, so as to provide more support and stability.

The surface of the sub-light source plates may be planar, or may have a certain degree of curvature. For example, the plurality of sub-light source plates may have a corresponding surface curvature at the portion facing the light-transmitting encapsulant.

In addition, the sub-light source plate may be connected to the heat dissipating material on the back surface facing the light-transmitting encapsulant. In other words, an aluminum sheet, a thermal adhesive or other heat dissipating materials may be applied to the back of the circuit board body corresponding to the light emitting diode die, so as to assist in heat dissipation.

In material aspect, the light source plate can be made by aluminum, a Flexible Printed Circuit (FPC) board, a FPC with aluminum, ceramics, glass or other materials. The light-transmitting encapsulant can be transparent, frosted, whitewashed inside, frosted and whitewashed inside . . . etc.

The heat dissipation material may be further connected to the transparent core. In other words, the heat of the sub-light source plates can be dissipated by transmitting through the transparent core.

In addition to be placed at the light bulb cap portion, the driving circuit of the power supply device may be housed in the inner space surrounded by the plurality of sub-light source plates. Moreover, the circuit board of the driving circuit may be a supporting structure for the sub-light source boards.

Furthermore, the plurality of sub-light source plates may be individually hung on the transparent core, so as to form the stereoscopic structure. The sub-light source plates may be individually connected to the power supply device, so as to obtain power. The light source plate is not necessarily folded to constitute the light source plate stereoscopic structure.

In addition, a radiating noble gas, such as helium, may be filled into the light-transmitting encapsulant, in order to assist the plurality of sub-light source plates to dissipate heat.

According to an embodiment of the present invention, a method for assembling a light bulb device is provided. The light-emitting diode dies are mounted on the circuit board through surface mount device technology. The packaging materials and the wires are provided on the circuit board. The circuit board is cut into a plurality of single light source circuit boards. The light source circuit board is folded to constitute a light source plate stereoscopic structure. The light source plate stereoscopic structure is installed on the transparent core. And then, as a module, a light bulb shell is installed outside. By an air inlet of the transparent core, the inside of the light bulb shell is vacuumed and then filled with noble gases. The air inlet is then sealed by heating and melting. Thereafter, the driving circuit, the cooling cup or lining, the light bulb cap and other components are installed, so as to complete the production of the light bulb.

By all means, not all of the above described steps shall be applied. According to different designs, each individual step can be adjusted, omitted, or added to other steps.

The above-described embodiments can reduce the manufacturing cost, increase the stability of the illumination device, and ensure the illumination device having a better appearance, so as to enhance the quality of life and ease of use.

DETAILED DESCRIPTION

Figure 1:
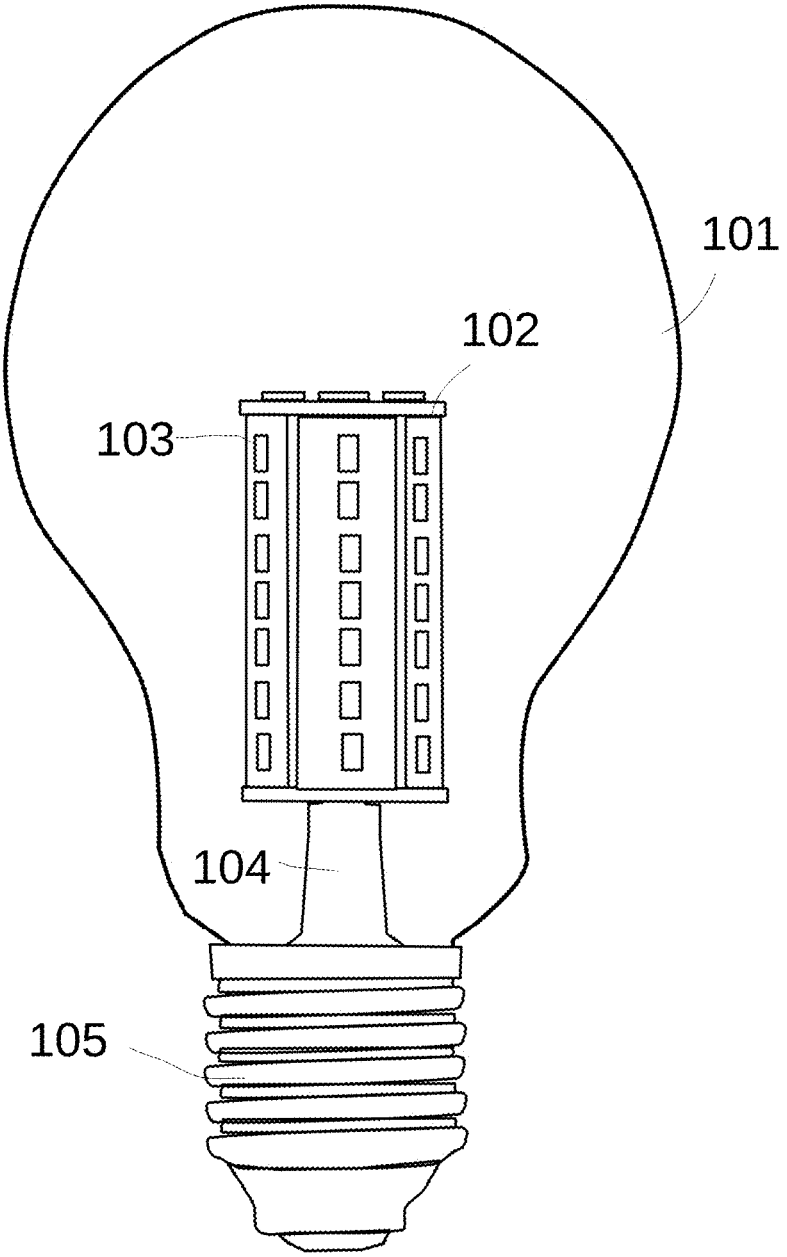
FIG. 1 is an exemplary embodiment of a light bulb in accordance with the present invention.
Figure 2:
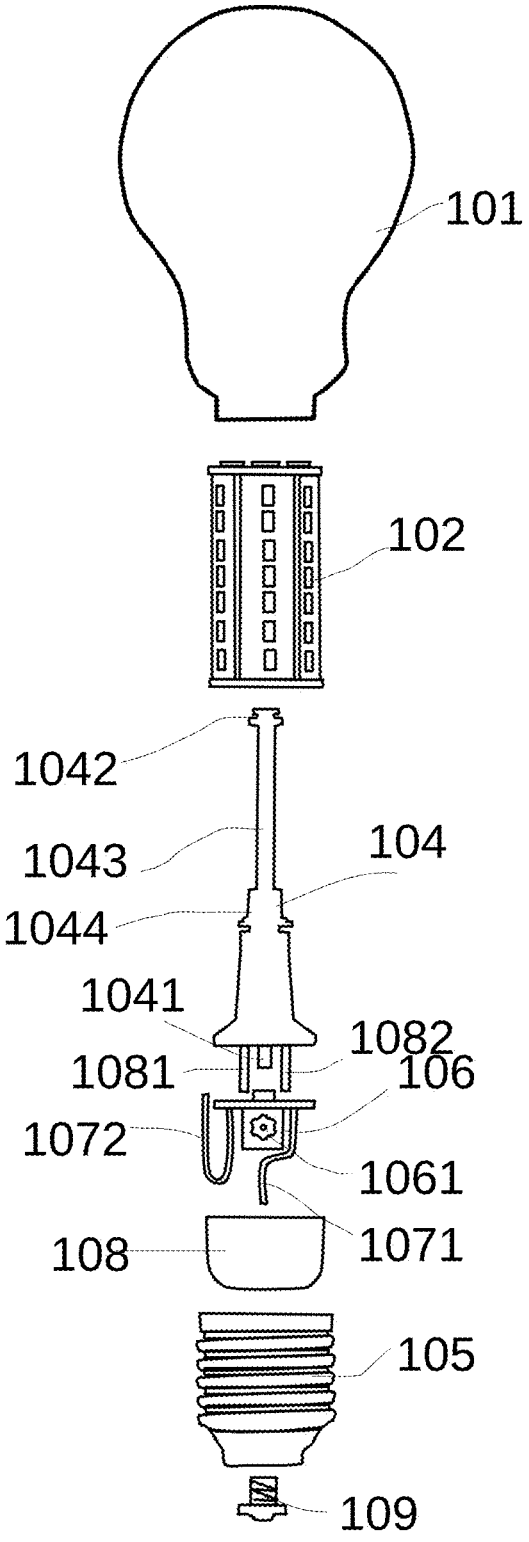
FIG. 2 is an exemplary embodiment illustrating the components in FIG. 1.

First, please refer to FIG. 1 and FIG. 2. FIG. 1 illustrates an embodiment of a light bulb in accordance with the present invention. FIG. 2 is an exemplary embodiment illustrating the components in FIG. 1.

FIG. 1 and FIG. 2 illustrate an example of a light bulb as a light emitting diode illumination device. In addition to the light bulb, the light emitting diode illumination device may be a lamp incorporating a battery, or an illumination device of other types of applications. The light emitting diode illumination device includes a light-transmitting encapsulant 101, a transparent core 104, and a light source plate stereoscopic structure 102. The light-transmitting encapsulant 101 and the transparent core 104 may be made of a transparent material such as glass or plastic.

The light source plate stereoscopic structure 102 may be comprised by a plurality of sub-light source plates. The light source plate stereoscopic structure disposed in the light-transmitting encapsulant 101 is connected to and supported by the transparent core 104. The sub-light source plates comprise a circuit board body and one or more light-emitting diode dies 103. The light-emitting diode dies 103 may be arranged in an equal distance, or may be disposed unequally from each other in a predetermined manner, depending on the shape and the design of the illumination device. For example, in order to have more illumination on the side surface and the bottom surface, light emitting diode dies can be disposed more intensively in particular areas of the sub-light source plates. In addition, the surface of the light-emitting diode dies 103 can be coated with phosphors, in order to produce different color temperatures. A plurality of light emitting diode dies having different color temperatures may be provided on the same circuit board body. The light emitting diode dies 103 are disposed on one side of the circuit board body, and are connected with each other in series via various packaging and wiring manners. For example, the light emitting diode dies 103 can be mounted to the circuit board body by a surface mount device (SMD) packaging manner. Also, the present invention can be used in a light source plate comprising the light emitting diodes packaged by the Chip on Board (COB) technology. However, for factories that are already familiar with the surface mount devices, COB technology is not necessarily employed. Therefore, manufacturing flexibility can be greatly enhanced while costs are reduced.

A power supply device supplies power to the sub-light source plates, in order to allow the sub-light source plates to provide illumination through the light-transmitting encapsulant. In the embodiment of the light bulb, the power supply device can be a corresponding driving circuit 1061 and a wire. The driving circuit 1061 may be mounted on the driving circuit board 106. The driving circuit 1061 is adapted to convert the voltage of the indoor power source into a voltage suitable for driving the light emitting diode dies 103 of the sub-light source plate, so as to emit light.

In other embodiments, the power supply device may further comprise a battery or simply a wire, so as to connect with an electrical power source.

When the embodiment of this illumination device is a light bulb, the illumination device may include a light bulb cap 105. The light-transmitting encapsulant 101 may be a light-transmitting encapsulant part corresponding to a variety of different types of light bulbs. For example, for T-type bulb shells, A-type bulb shells, G-type bulb shells, R-type bulb shells, BR-type bulb shells, PAR-type bulb shells, candle-type bulb shells or any other existing bulb shapes.

In the embodiment of the light bulb, the driving circuit 1061 may be housed in an accommodating space of the light bulb cap 105. In other words, only the light source plate stereoscopic structure 102 and the transparent core 104 are visible through the light-transmitting encapsulant 101. The circuit elements of the driving circuit 1061 are not visible. The driving circuit 1061 may be partially shaded, so that the components of the driving circuit 1061 are not exposed directly, affecting the overall appearance of the light bulb product.

A heat sink can be further provided in order to better dissipate heat, so as to increase the life of the light bulb or other illumination device. For example, a cooling cups 108, cooling materials, or various of linings may be placed inside the light bulb cap, so as to dissipate heat of the driving circuit and the sub-light source plates.

In addition, a wire can be embedded in the transparent core 104. A first group of terminals 1081 and a second group of terminals 1082 are provided on both sides of the wire, respectively. The first group of terminals 1081 are electrically connected to the sub-light source plates, while the second group of terminals 1082 are electrically connected to the power supply device, such as a driving circuit 1061. The driving circuit 1061 may further comprises extending external terminals 1071 and 1072, so as electrically connect to the external electrical connection terminals of the light bulb cap 105, such as the sidewall and the bottom terminals 109 of the light bulb cap 105, in order to connect to an external power source of the lamp. Alternatively, the wires may be connected to the sub-light source plates and the power source device along the surface or exterior of the core. In the embodiment, the light source plate stereoscopic structure 102 is a hollow structure. The transparent core 104 penetrates the light source plate stereoscopic structure 102, and the top portion 1042 of transparent core 104 supports the top portion of the light source plate stereoscopic structure 102. The bottom portion 1044 of the transparent core 104 connects to and supports the bottom portion of the light source plate stereoscopic structure 102. The middle portion 1043 of the transparent core 104 is surrounded by the light source plate stereoscopic structure 102.

Figure 3:
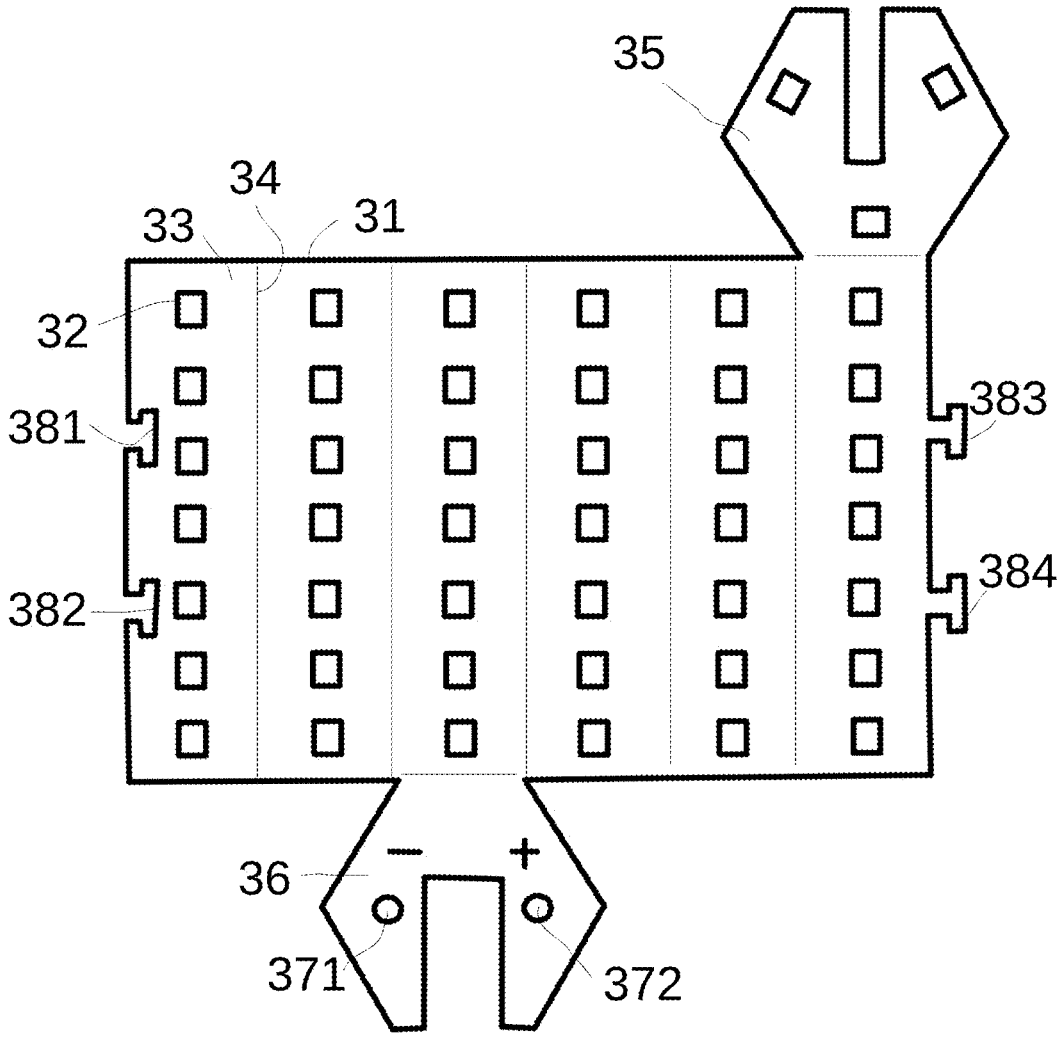
FIG. 3 is an exemplary embodiment of a light source circuit board used for folding.

Please refer to FIG. 3 illustrating a schematic diagram of a light source circuit board 31 which can be used for folding. A plurality of light emitting diode dies 32 may be packaged on one side of the light source circuit board. The above-described plurality of sub-light source plates 33 may be different portions of one light source circuit board 31. The light source circuit board 31 may be provided with grooves 34, so as to facilitate folding. By folding the light source circuit board 31, a folding angle is generated between the sub-light source plates 31, so as to constitute the light source plate stereoscopic structure. In order to constitute a stable stereoscopic structure, the two side edges of the light source circuit board 31 may further comprise buckle structures 381, 382, 383, and 384. After folding, the buckle structures may be engaged to each other. It is noted that the quantity and shape of the buckles illustrated herein are not intended to limit the scope of the invention. A variety of other buckle structures may be substitutes. In addition, in FIG. 3, the light source circuit board 31 further comprises a top portion 35 and a bottom portion 36. The top portion 35 further comprises light emitting diode dies, so as to increase the total amount of illumination. The bottom portion 36 comprises terminals 371 and 372, so as to connect to an external power supply.

Figure 4:
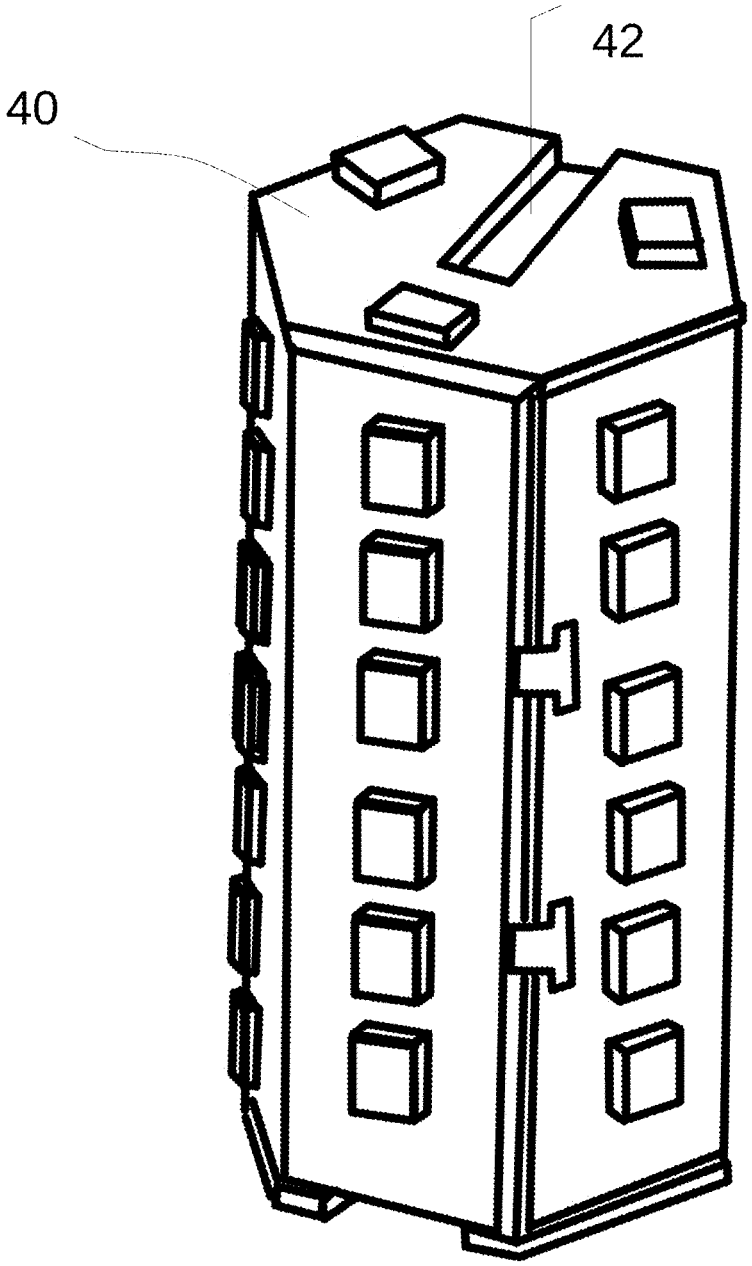
FIG. 4 is an exemplary embodiment of a stereoscopic structure after the light source circuit board in FIG. 3 is folded.

FIG. 4 illustrates a schematic perspective view of the light source circuit board of FIG. 3, after folding. 42 comprises a hole, so as to allow the top portion of the transparent core to penetrate and to support the light source plate stereoscopic structure 40.

Figure 5:
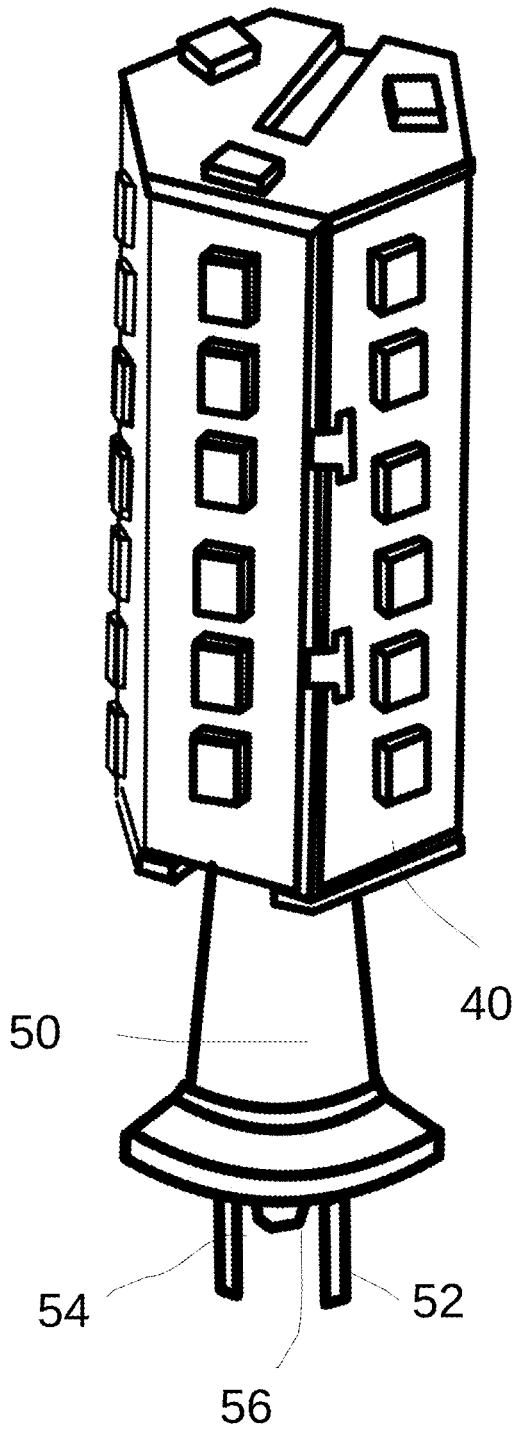
FIG. 5 is an exemplary embodiment of the light source plate stereoscopic structure in FIG. 4 further installed in a transparent core.

FIG. 5 illustrates a schematic view of the light source plate stereoscopic structure 40 of FIG. 4 further mounted on the transparent core 50. The electrical terminals of the light source plate stereoscopic structure 40 are connected to the first set of terminals of the transparent core 50, and are connected to the second set of terminals 52, 54 of the transparent core through the wires embedded in the transparent core. In addition, the transparent core 50 may further comprise a corresponding projection 54 or alike, so as to provide a more stable positioning connection to the light bulb cap.

Figure 6:
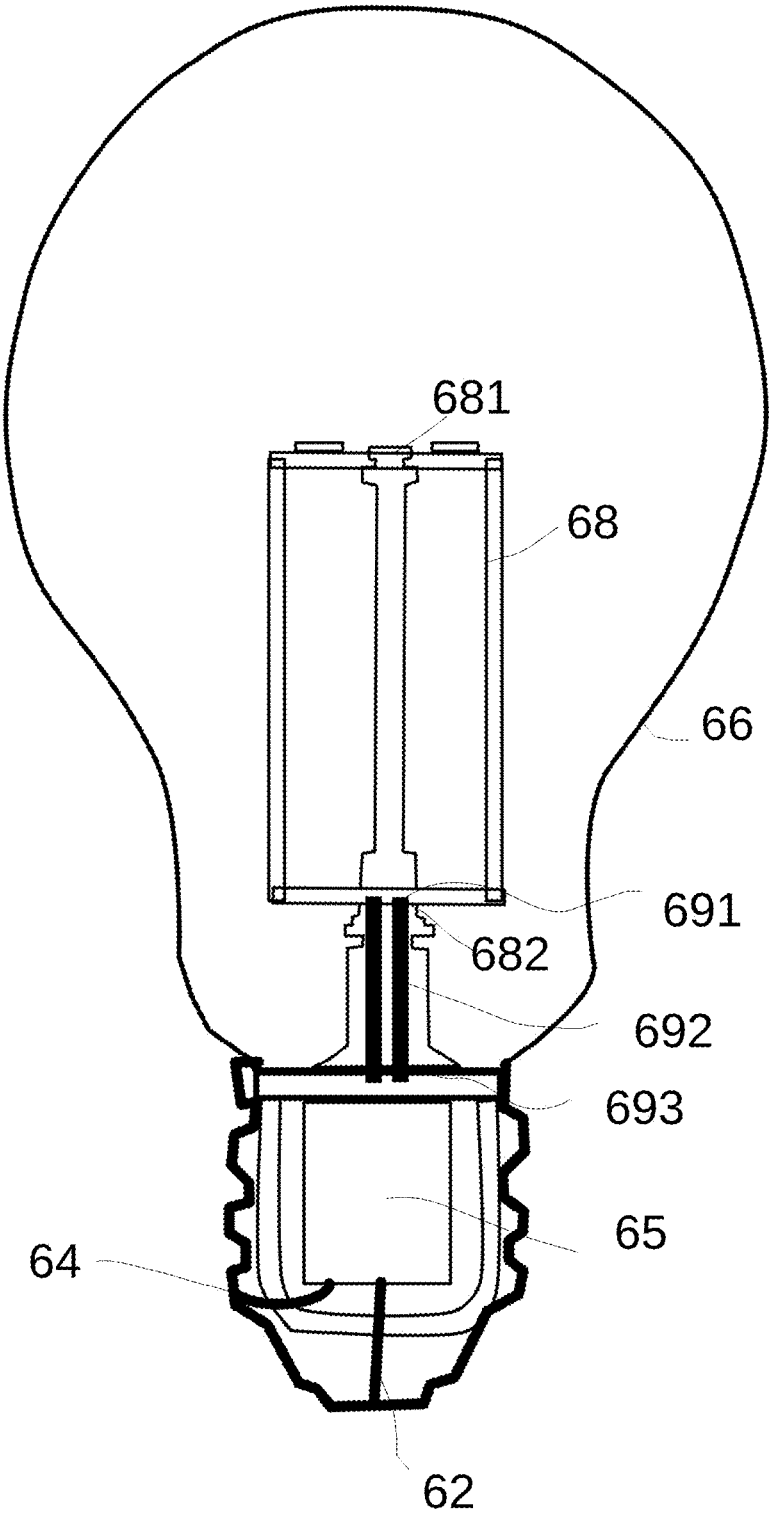
FIG. 6 is an exemplary embodiment of a cross-sectional view of a light bulb device.

FIG. 6 illustrates a cross-sectional view of an embodiment of a light bulb device. In the embodiment, the top portion of the light source plate stereoscopic structure 68 is supported by the top portion 681 of the transparent core. The bottom portion of the light source plate stereoscopic structure 68 is supported by the bottom portion 682 of the transparent core. The light source plate stereoscopic structure 68 illuminates outwardly toward the light-transmitting encapsulant 66. The transparent core has a first set of terminals 691 electrically connected to the light source plate stereoscopic structure 68. Further, a wire 692 embedded in the transparent core extends to electrically connect to a second set of terminals 693. The second group of terminals 693 are electrically connected to a driving circuit 65. Through a wire or a conducting sheet 62 and 64, the driving circuit 65 is further connected to an external power source.

Figure 7:
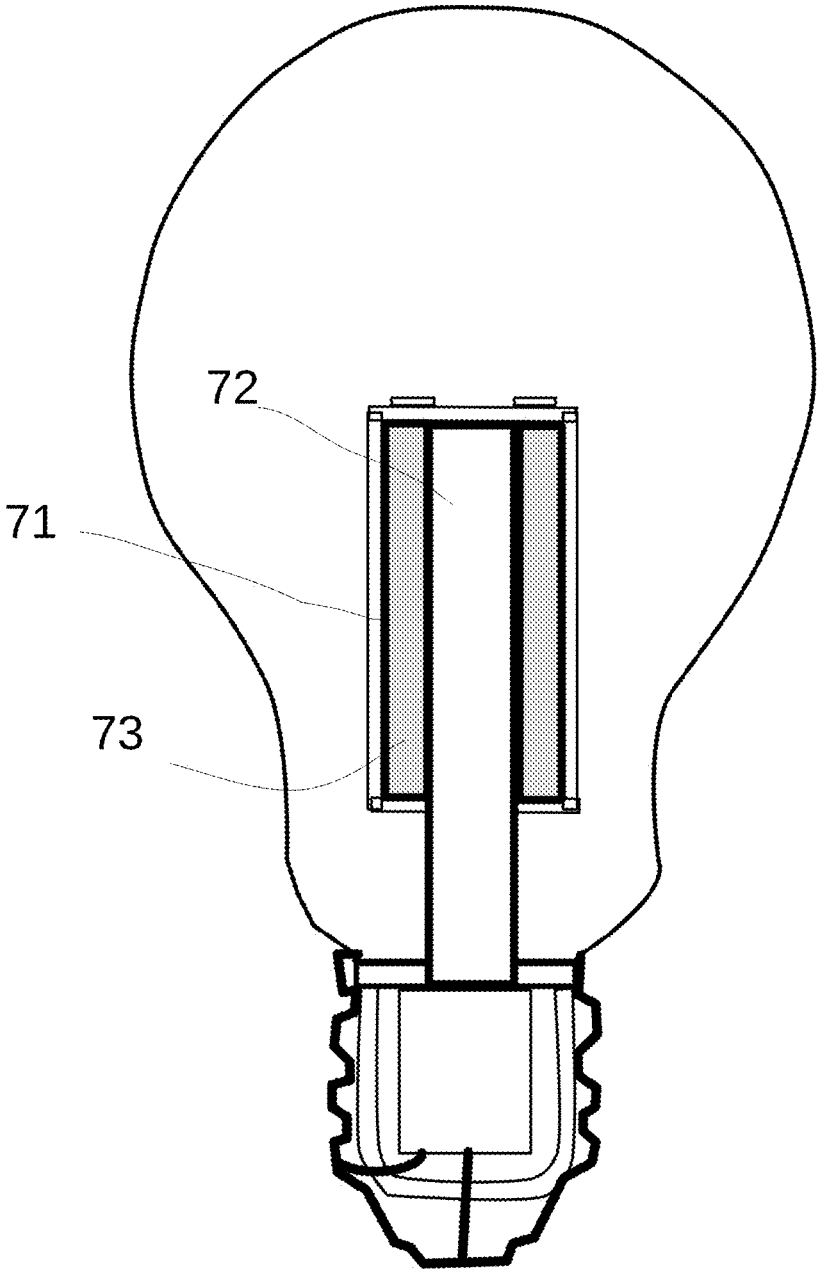
FIG. 7 is another exemplary embodiment of a cross-sectional view of a light bulb.

FIG. 7 illustrates a cross-sectional view of still another embodiment of the light bulb. In the embodiment, a driving circuit board 72 is surrounded by the light source plate stereoscopic structure 71. The heat dissipating material 73 is filled between the light source plate stereoscopic structure 71 and the driving circuit board 72. The lower portion of the driving circuit board 72 may be connected to the transparent core, so as to be further connected to other structures of the light bulb cap.

Figure 8A:
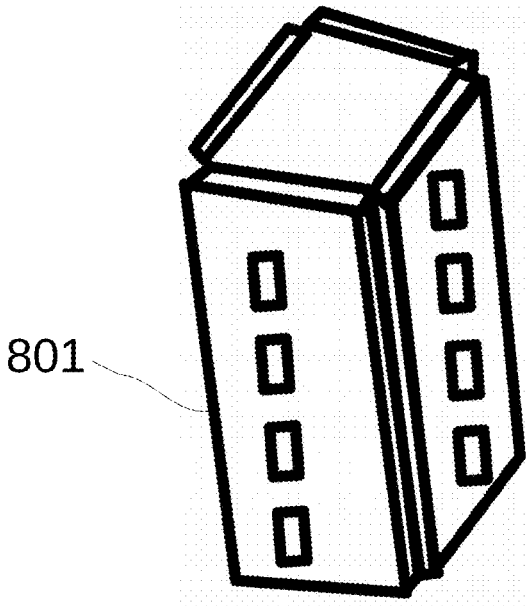
FIG. 8A is another exemplary embodiment of a light source plate stereoscopic structure.

FIG. 8A illustrates a schematic view of still another light source plate stereoscopic structure. In this illustration, the light source plate stereoscopic structure is a quadrilateral cylinder 801. By all means, the light source plate stereoscopic structure can be pentagonal, triangular or other polygonal columns.

Figure 8B:
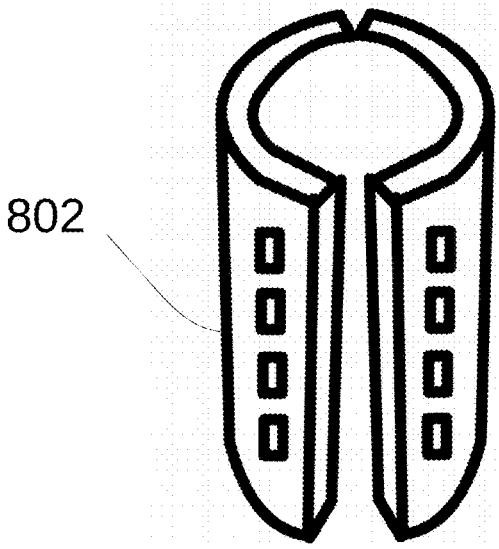
FIG. 8B is still another exemplary embodiment of a light source plate stereoscopic structure.

FIG. 8B illustrates a schematic view of still another light source plate stereoscopic structure. The light source plate stereoscopic structure is constituted by two surface-curved sub-light source plates 802.

In other words, the LED die can be mounted on a large circuit board, then the wires are installed. The circuit board is then cut into a predestinated shape, leaving grooves suitable for folding. Next, each light source circuit board is folded to form a light source plate stereoscopic structure, so as to connect with the transparent core. This approach can significantly reduce costs and reduce the difficulty of installation.

In addition, a portion of the light source circuit board can be folded to constitute a top portion of the light source circuit board. The top portion of the light source circuit board is connected to a top portion of the transparent core, and is supported thereby.

The top of the light source circuit board can further comprises light emitting diode dies. In addition, the top portion of the light source circuit board may further comprise a buckle structure, so as to be fastened to the top of the transparent core. In addition, the top portion of the light source circuit board can also be connected with the transparent core via adhesive or welding. Furthermore, another portion of the light source circuit board may be folded to constitute a bottom portion of the light source circuit board. The bottom portion of the light source circuit board is connected to a bottom portion of the transparent core, and is supported thereby.

The light source circuit board can be folded into a variety of stereoscopic structures. For example, the plurality of sub-light source plates may be folded into a polygonal column structure. In order to ensure the modularity and stability of the light source plate stereoscopic structure, when the light source circuit board is folded into the polygonal column structure, two of the sub-light source plates are connected with each other through corresponding buckles. In other words, when the light source circuit board is folded into a polygonal shape, the last two side ends can be fastened by buckle structures, so as to form a hollow cylinder structure. In addition, the shape of the light source plate stereoscopic structure can also be ensured by adhesive or welding. Furthermore, these sub-light source plates can also be connected with the connecting structure between the transparent core, so as to provide more support and stability.

The surface of the sub-light source plates may be planar, or may have a certain degree of curvature. For example, the plurality of sub-light source plates may have a corresponding surface curvature at the portion facing the light-transmitting encapsulant.

In addition, the sub-light source plate may be connected to the heat dissipating material on the back surface facing the light-transmitting encapsulant.

In other words, an aluminum sheet, a thermal adhesive or other heat dissipating materials may be applied to the back of the circuit board body in respect to the light emitting diode die, so as to facilitate heat dissipation. The heat dissipation material may be further connected to the transparent core. In other words, the heat of the sub-light source plates can be dissipated by transmitting through the transparent core.

In addition to be placed at the light bulb cap portion, the driving circuit of the power supply device may be housed in the inner space surrounded by the plurality of sub-light source plates. Moreover, the circuit board of the driving circuit may be a supporting structure of the sub-light source boards. Furthermore, the plurality of sub-light source plates may be individually hung on the transparent core, so as to form a stereoscopic structure. The sub-light source plates may be individually connected to the power supply device, so as to obtain power. The light source plate stereoscopic structure is not necessarily formed by the manner of folding the light source plate.

In addition, a radiating noble gas, such as helium, may be filled inside the light-transmitting encapsulant to assist the plurality of sub-light source plates to dissipate heat.

Figure 9:
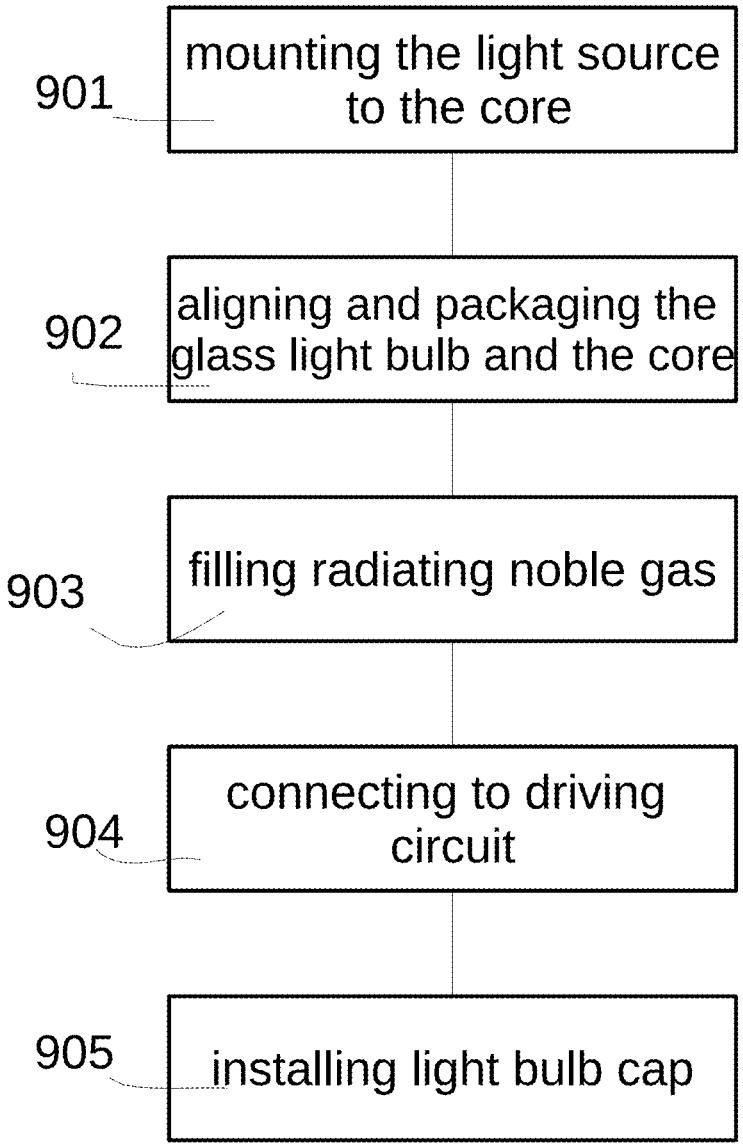
FIG. 9 is a flow chart of manufacturing a light bulb in accordance with the present invention.

Please refer to FIG. 9. FIG. 9 is a flow chart for manufacturing a light bulb in accordance with the present invention. In the embodiment, a method for assembling a light bulb device is provided. The light-emitting diode dies are mounted on the circuit board through surface mount device technology. The packaging materials and the wires are provided on the circuit board. The circuit board is cut into a plurality of single light source circuit boards. The light source circuit board is folded to constitute a light source plate stereoscopic structure. The light source plate stereoscopic structure is installed on the transparent core (step 901), and then, as a module, a light bulb shell is installed outside (step 902). By an air inlet of the transparent core, the Inside of the light bulb shell is vacuumed and then filled with noble gases (step 903). The air inlet is then sealed by heating and melting. In consequence, installing the driving circuit (step 904), installing a cooling cup or a lining and a light bulb cap (step 905) as well as other components, so as to complete the production of the light bulb. By all means, not all of the above described steps shall be applied. According to different designs, each individual step can be adjusted, omitted, or added to other steps.

In addition to the above-described examples, other modifications and variations are intended to be included within the scope of the present invention as long as they are within the scope of the present invention.

The invention claimed is:

1. A light emitting diode illumination device, comprising:

a light-transmitting encapsulant;

a transparent core made by a transparent material;

a light source plate stereoscopic structure comprising a plurality of sub-light source plates, the light source plate stereoscopic structure being installed in the light-transmitting encapsulant, wherein the light source plate stereoscopic structure is connected to the transparent core and is supported thereby, the sub-light source plates comprising a circuit board body and light emitting diode dies, wherein the light emitting diode dies are disposed on one side of the circuit board body; and a power supply device used for providing electrical power to the sub-light source plates, so as to allow the plurality of sub-light source plates to provide illumination though the light-transmitting encapsulant, wherein the sub-light source plates are different portions of the light source circuit board, and by folding the light source circuit board, a folding angle between the sub-light source plates are generated, so as to constitute the light source plate stereoscopic structure with a tube having a top end and a bottom end, a portion of the light source circuit board is folded to constitute a top portion of the light source circuit board, the top portion concealing the top end of the tube, and the top portion of the light source circuit board is connected to a top portion of the transparent core and the light source plate stereoscopic structure is supported by the connection of the top portion of the light source circuit board and the top portion of the transparent core, a main portion of the transparent core is extended from a bottom portion to the top portion and the main portion of the transparent core is enclosed by the light source plate stereoscopic structure, the top portion of the light source board is above other portions of the light board; and wherein a portion of the light source circuit board is folded to constitute a bottom portion of the light source circuit board, while the bottom portion of the light source circuit board is connected to a bottom portion of the transparent core and is supported thereby.

2. The light emitting diode illumination device of claim 1, wherein the transparent material is glass.

3. The light emitting diode illumination device of claim 1, wherein the power supply device comprises a driving circuit used for converting the voltage of the indoor power source into a voltage suitable for driving the light emitting diode dies of the sub-light source plate to emit light.

4. The light emitting diode illumination device of claim 3, further comprising a light bulb cap, wherein the driving circuit is housed in an accommodating space of the light bulb cap, and the light source plate stereoscopic structure and the transparent core are visible through the light-transmitting encapsulant while the circuit elements of the driving circuit are not visible.

5. The light emitting diode illumination device of claim 4, further comprising a heat sink disposed in the light bulb cap, wherein the heat sink is used for dissipate heat of the driving circuit and the sub-light source plates.

6. The light emitting diode illumination device of claim 1, wherein a wire is further embedded in the transparent core, and a first group of terminals and a second group of terminals are further provided on both sides of the wire, and the first group of terminals are electrically connected to the sub-light source plates while the second group of terminals are electrically connected to the power supply device.

7. The light emitting diode illumination device of claim 1, wherein the light emitting diode illumination device is a light emitting diode light bulb.

8. The light emitting diode illumination device of claim 1, wherein the top portion of the light source circuit board further comprises light emitting diode dies.

9. The light emitting diode illumination device of claim 1, wherein the top portion of the light source circuit board further comprises buckle structures, so as to be fastened to the top portion of the transparent core.

10. The light emitting diode illumination device of claim 1, wherein the plurality of sub-light source plates are folded to constitute a polygonal column structure.

11. The light emitting diode illumination device of claim 10, wherein two of the sub-light source plates are connected with each other through corresponding buckles, when the light source circuit board is folded to constitute the polygonal column structure.

12. The light emitting diode illumination device of claim 1, wherein the plurality of sub-light source plates have a corresponding surface curvature at the portion facing the light-transmitting encapsulant.

13. The light emitting diode illumination device of claim 1, wherein the sub-light source plate is connected to a heat dissipating material on the back surface facing the light-transmitting encapsulant.

14. The light emitting diode illumination device of claim 13, wherein the heat dissipating material is connected to the transparent core and the sub-light source plates.

15. The light emitting diode illumination device of claim 1, wherein a driving circuit of the power supply device is housed in the inner space surrounded by the plurality of sub-light source plates.

16. The light emitting diode illumination device of claim 1, wherein the plurality of sub-light source plates are individually hung on the transparent core.

17. The light emitting diode illumination device of claim 1, wherein the light emitting diode dies of the sub-light source plates are mounted to the circuit board body in a surface mount device packaging manner.

18. The light emitting diode illumination device of claim 1, further comprising a noble gas filled inside the light-transmitting encapsulant, so as to assist the plurality of sub-light source plates to dissipate heat.

* * * * *